US010161123B2

(12) United States Patent
Campbell

(10) Patent No.: US 10,161,123 B2
(45) **Date of Patent: *Dec. 25, 2018**

(54) VENTILATED TOILET ASSEMBLY

(71) Applicant: Donald Campbell, Albuquerque, NM (US)

(72) Inventor: Donald Campbell, Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/352,579

(22) Filed: Nov. 16, 2016

(65) Prior Publication Data

US 2017/0138033 A1 May 18, 2017

Related U.S. Application Data

(63) Continuation-in-part of application No. 14/658,223, filed on Mar. 15, 2015, now Pat. No. 9,644,360.

(51) Int. Cl.
*E03D 9/04* (2006.01)
*E03D 9/052* (2006.01)

(52) U.S. Cl.
CPC ..... *E03D 9/052* (2013.01)

(58) Field of Classification Search
CPC ..... E03D 9/052; E03D 9/05
USPC ..... 4/213, 216
See application file for complete search history.

(56) References Cited

U.S. PATENT DOCUMENTS

| | | | | |
|---|---|---|---|---|
| 1,955,579 | A * | 4/1934 | De Malaussene | E03D 9/052 4/213 |
| 4,365,361 | A * | 12/1982 | Sanstrom | E03D 9/052 4/213 |
| 5,345,617 | A * | 9/1994 | Jahner | A47K 13/307 4/217 |
| 5,727,263 | A * | 3/1998 | Hugo Ceja Estrada | E03D 9/05 4/216 |
| 5,809,581 | A * | 9/1998 | Brown | E03D 9/052 4/209 R |
| 8,973,174 | B2 * | 3/2015 | Palazzola | E03D 9/052 4/216 |
| 9,644,360 | B2 * | 5/2017 | Campbell | E03D 9/052 |
| 2016/0186420 | A1 * | 6/2016 | Darnell | E03D 9/05 4/352 |

* cited by examiner

*Primary Examiner* — Huyen Le
(74) *Attorney, Agent, or Firm* — Justin R. Muehlmeyer; Janeen Vilven; Peacock Law P.C.

(57) ABSTRACT

Disclosed herein is a unique ventilated toilet assembly. The toilet assembly includes a base with a central opening, the opening defining a toilet bowl. The toilet assembly includes a first annular ring above the base, the first annular ring having means for delivering water to the toilet bowl and a second annular ring surrounding the first annular ring. The second annular ring having side walls, a top wall and a bottom wall, the walls defining a conduit for exhausting air through the second annular ring and the second annular ring having exhaust ports for exhausting air from the toilet bowl. The ventilation member includes the combination of the second annular ring, the conduit, and the exhaust port for exhausting air working cooperatively to capture and remove waste air from the toilet bowl.

17 Claims, 14 Drawing Sheets

Section B

VENTILATED TOILET ASSEMBLY

CROSS-REFERENCE TO CURRENTLY PENDING APPLICATION

This application is a continuation-in-part application to U.S. Ser. No. 14/658,223 filed Mar. 15, 2015 and has the same inventive entity.

BACKGROUND OF THE INVENTION

Field of the Invention

This invention relates to the field of human waste disposal systems. More particularly, this invention relates to ventilated toilet in a bathroom designed for the purpose of disposing of human waste.

Background

For most, the discussion of human waste is one to avoid. There's not much humorous or glamorous about discussions relating to the handling and disposal of human waste. However, regardless of how distasteful such discussions might be to some, there is a growing need to dispose of human waste properly, so as to leave the environment as healthy as possible after excrement. It is incumbent upon all of us that occupy the planet to pay attention to this aspect of life, since each of us contributes to human waste regardless of our station in life. For without proper handling of human waste the quality of life on our planet will rapidly decrease.

Everyone can agree that as long as there is human life, there will be human waste. As the human population increases, the amount of waste needing to be handled properly also increases and perhaps even exponentially so since old dumping methods are not only unsafe, but impractical as we run out of space for handling such waste using traditional methods.

In a typical structure, there is a commode for housing a toilet. The toilet is housed in the commode. Typically for privacy, the commode is provided with a door. The door also has the effect of restricting airflow and reducing the effect of malignant odors on the rest of the environment, when the door is closed. The toilet includes plumbing and electrical connection to accomplish its purpose and dispose of waste into a septic or city sewage system. The commode may even be provided with an exhaust fan in many cases. Typically, laws in most states in the US require the commode to have an exhaust fan for building new or improving structures.

One of the more obnoxious bi-products of human waste is the odor produced during defecation and urination. The bi-products of human waste mix with the ambient air and then permeate the bathroom or commode. Sometimes, for example in a private home, the odor becomes so obnoxious that even closing the commode door won't prevent the odor from permeating the house or apartment or residence. Of course, bathroom doors are designed for privacy and not for hermetically sealing in odors.

The obnoxious odor requires others sometimes to flee the residence for the time in which it takes to clear or de-odorize the air. In some cases, it can be quite some time before the odor is removed, even with an exhaust fan. Alternatively, the residents may use air freshener. However, some air fresheners may prove to be harmful.

As noted above, in the past, commodes have been equipped with exhaust fans for expelling the waste air. It will be appreciated that to a limited extent these types of devices have proved to be effective. However, such devices tend to be inefficient because the entire volume of air in the commode is subjected to the exhaust fan. The volume of air in the toilet bowl from which the odor originates and immediately adjacent thereto is many times smaller than the air in the commode itself. For example the air in the commode is typically 700 cubic feet while the air in the bowl and immediately surrounding area is less than one cubic foot. When one considers that in the US alone over 16 billion rolls of toilet paper were used and it is estimated that over 4 million cubic feet of exhaust air needed to be moved the issue of removing human waste exhaust air is indeed, substantial.

Not only is the present method of clearing the waste air from the commode inefficient, as described above, but it has a tendency to waste considerable energy resources. As described above, present methods of evacuating the waste air requires that the entire volume of air in the commode to be involved with waste air removal. Given that the volume of air in the entire commode is many times that of the area of the toilet bowl, there is considerable more energy required to remove the waste air from the commode than the toilet bowl.

What is needed is a more cost effective and more efficient method and apparatus to remove waste air from a commode or similar area for the removal of human waste.

SUMMARY OF THE INVENTION

Applicant discloses herein a unique approach to removing waste odor from a toilet bowl. In one exemplary embodiment, the disclosure herein utilizes the existing modern toilet structure and modifies it, so that a ventilation member is provided at the toilet bowl to remove waste air. Thus, instead of removing waste air from the entire commode, only the waste air from the toilet needs to be removed.

As a direct result of the reducing waste air volume, there are considerable energy savings. Specifically, calculations which include adjusting for different climate zones show how savings vary with cooling/heating degree days, utility rates, and air volume which varies by building occupancy and use. This is driven both by function and code requirements.

Energy is also saved because not all the air in the commode is evacuated using the device of the instant disclosure. Since only the exhaust air in the immediate vicinity of the toilet is exhausted, the remaining portion of the commode air remains at the ambient temperature prior to use of the commode. For example, on a below zero day in Duluth, Minn., the entire commode would need to be re-heated in order to bring the temperature of the commode air back to where it was prior to use. The same is true, energy wise, on a scorching hot day in Arizona, where the temperature can easily reach 120 degrees during a hot summer day. All the commode air would need to be cooled to bring the comfort levels back to normal.

It is estimated that it energy costs between $20 to $90 per year for each conventional toilet. The comparable cost for a ventilated toilet operated is estimated to be less than $1 per year per toilet. The costs of additional water is not included.

Energy costs would most likely increase dramatically if natural ventilation methods, such as an open window, were employed. For example during extreme cold or heat an open window would not only lead to air conditioned air, the user may well forget to close the window after the odor had disappeared. The energy costs would rise exponentially.

Other benefits directly attributable include reducing energy consumption to achieve use of the ventilated toilet for Green Buildings, Title 24 compliance, Net Zero Construction, ASHRAE or other certifications as minimum for compliance.

Additionally, as a direct result of the exhaust in the immediate proximity of the toilet bowl, the most intense odors are captured immediately and shortly after they are created and well before the odors can fully permeate the commode. Thus using appropriate waste air capture techniques, the waste odors are contained and removed immediately and efficiently, thus promoting better environmental conditions for those in the immediate area and for everyone by capturing the waste air so it can be treated.

The ventilated toilet assembly accordingly includes: the toilet assembly including a base with a central opening, the opening defining a toilet bowl, the ventilated toilet assembly comprising:

- a first annular ring above the base, the first annular ring having means for delivering water to the toilet bowl;
- a second annular ring above the first annular ring, the second annular ring having side walls, a top wall and a bottom wall, the walls defining a conduit for exhausting air through the second annular ring; and the second annular ring including a ventilation member, the ventilation member including the conduit for exhausting air from the toilet bowl, the conduit having an exhaust port in communication with the toilet bowl and the area outside the toilet bowl for exhausting air from the toilet bowl through the conduit.

In another exemplary embodiment, the toilet assembly includes a toilet seat over the second annular ring. As is typical, a space is formed between the second annular ring and the toilet seat. A gasket member fills the space between the toilet seat and the second annular ring for preventing air from escaping the toilet bowl and maintaining adequate exhaust air capture velocity.

In another exemplary embodiment, the toilet assembly includes a second annular ring having a depressed front portion defining a weir and a rear diametrically opposite the front portion defining a vent. The vent being in communication with the exhaust port.

Capture velocities are achieved when the air velocity exceeds the natural physical phenomenon or forces that cause air to migrate from one area to another, thus preventing odors, contaminants, or pollutants from moving beyond a boundary. That boundary is established by physical barriers, in this case the toilet bowl, as well as effective barrier created by the plane at the opening of the toilet bowl where the inward air velocity exceeds the capture velocity. The claimed structure herein provides controlled and optimized forced exhaust ventilation directly from the toilet bowl interior to the exhaust ports. In the exemplary embodiments described herein odor is limited to the immediate vicinity of the toilet bowl. The odor is rapidly diluted and exhausted as described herein.

In another exemplary embodiment, the second annular ring is generally hollow with the exception that a small portion is solid and acts a dam not allowing the flow of air throughout the conduit of the second annular ring. Additionally in order to prevent water from getting into the conduit, the second annular ring includes a center portion and the center portion is depressed into a thin solid layer defining a weir. Preferably, the layer is as thing as possible without damaging the integrity of the second annular ring.

In another exemplary embodiment, the exhaust port has 5" square of area and is divided into three sections.

In another exemplary embodiment, the second annular ring has a drain to allow any water getting into the conduit to drain into the bow. In order to achieve the desired result the bottom wall of the conduit is sloped to define a low point. The drain is positioned at this low point to allow any water in the conduit to flow into the drain. The drain communicates with the toilet bowl and is disposed of in the conventional way that liquids or solid matter reach the toilet bowl. In one embodiment the drain is separate from the exhaust ports. In another embodiment, the drain is the same as the exhaust ports.

In another exemplary embodiment, the assembly includes an air injector for injecting air into the toilet bowl through the second annular ring For example, in the exemplary embodiment where the structure herein is used in a forced air bidet, the exhaust air requirement is increased by the same amount as the air introduced into the bowl. Correspondingly, the exhaust air intake ports are all proportionately increased in size.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE VENTILATED TOILET ASSEMBLY

Figure 1:
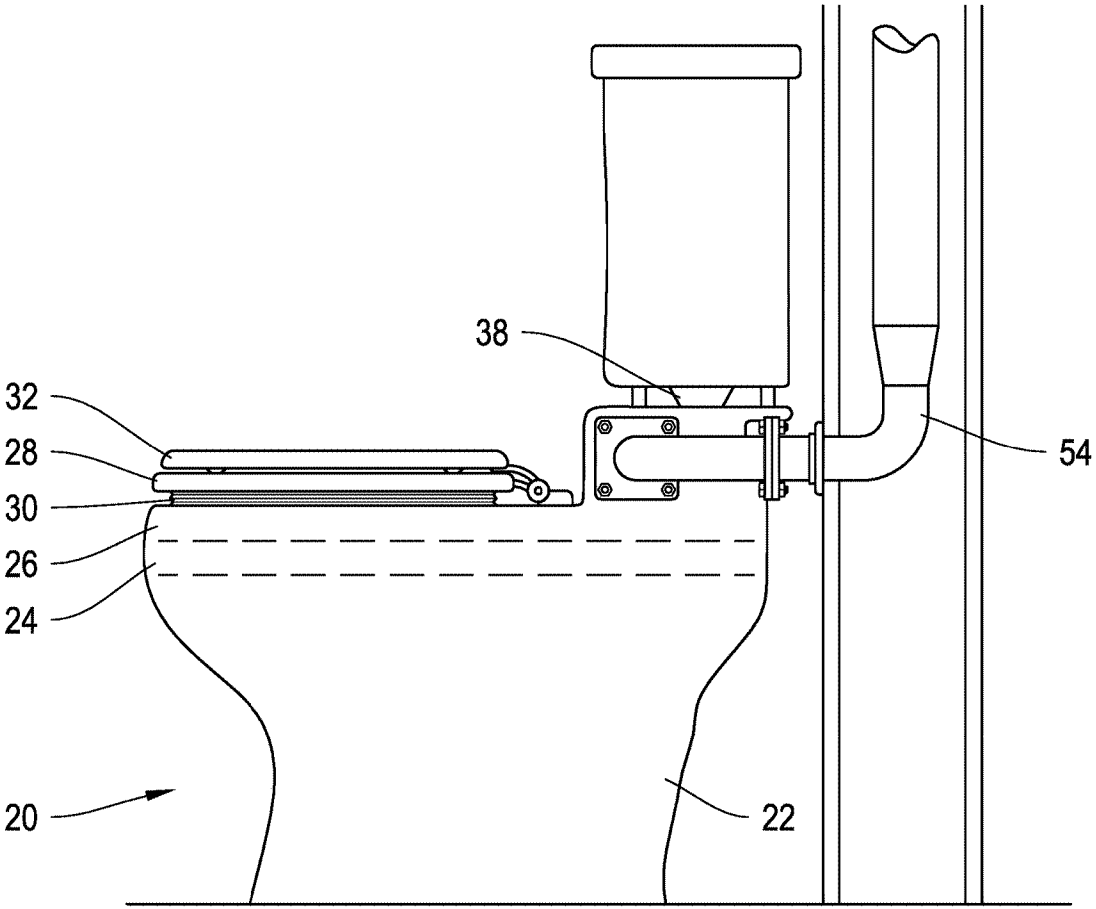
FIG. 1 illustrates a side perspective view of the ventilated toilet assembly in accordance with the disclosure herein.

The invention will now be described with respect to FIGS. 1-10, which illustrate an exemplary embodiment of the disclosure herein. Particularly, with respect to FIGS. 1-7, there is shown an exemplary embodiment illustrating a ventilated toilet assembly, disclosed by the applicant herein, and generally indicated by the numeral 20. The ventilated toilet assembly 20 disclosed herein includes a base 22, a first annular ring 24, a second annular ring 26, a toilet seat 28 and a gasket 30 between the toilet seat 28 and the second annular ring 26. Additionally, a toilet seat cover 32 is provided which covers the toilet seat 28.

Figure 2:
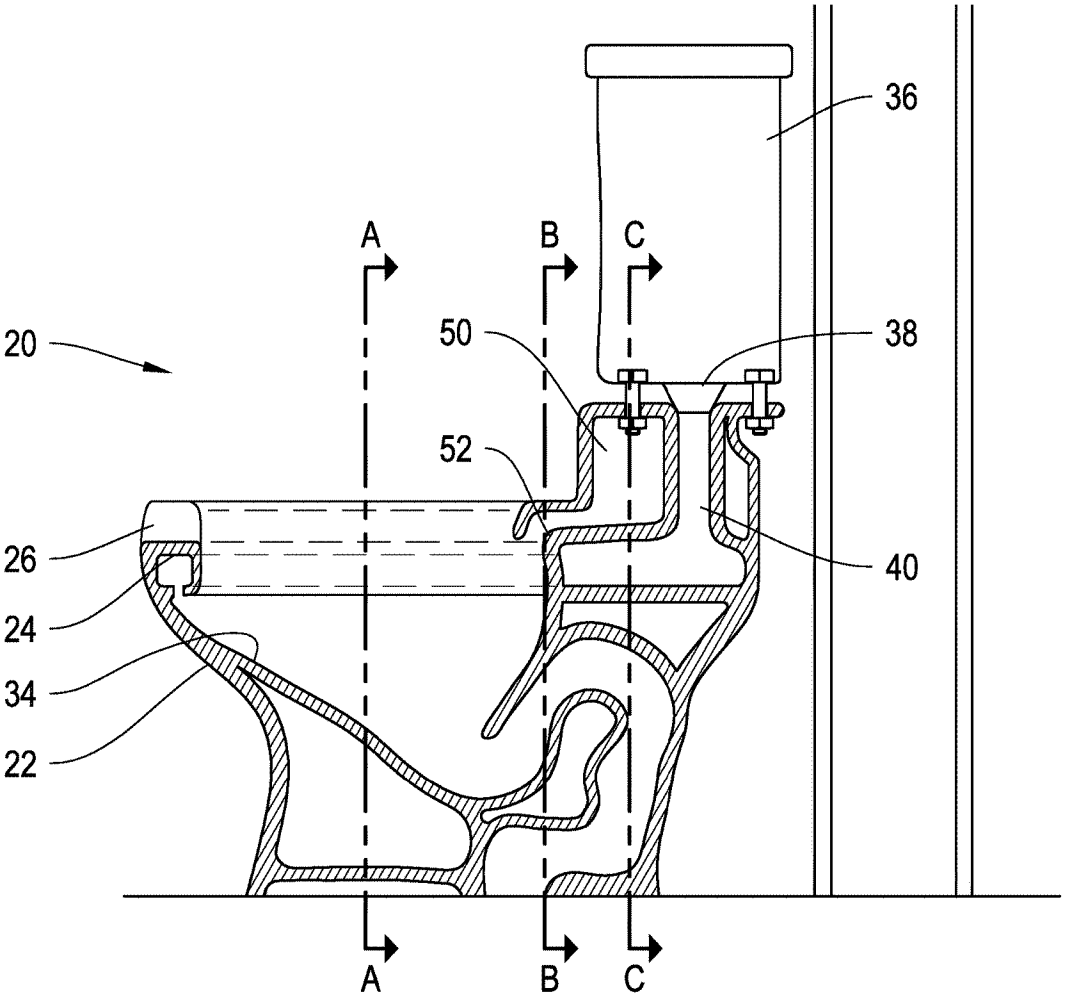
FIG. 2 illustrates a cut away side perspective view of the ventilated toilet assembly in accordance with the disclosure herein.

In the first exemplary embodiment illustrated in cross section in FIG. 2, the ventilated toilet assembly 20, the base 22 comprises a standard modern toilet base. The base 22 sits on the floor of a bathroom or other toilet or human waste removing facility and is secured to the floor therein. The base 22 is typically made from porcelain as is well known. However, in the future other materials may become available and well-suited for the purposes herein. The invention is specifically not limited to any particular base 22 material.

The base 22 has a central opening defining a toilet bowl 34. The central opening is left open until the cover 32 covers the toilet bowl 34, not illustrated in FIG. 2.

The first annular ring 24 sits on the base 22 as illustrated in FIG. 2. As is conventional, the first annular ring 24 carries water from outside the toilet bowl 34 to the surface of the toilet bowl 34 in a manner commonly known. In the exemplary embodiment of FIG. 2, the back of the toilet assembly 20 includes a water tank 36 attached to the base 22. (FIG. 8) The tank 36 is attached to the upper portion of the base and the connection there between is sealed using a gasket 38. As is conventional, water flows from the tank 36 through a conduit 40 to the first annular ring 24. Upon flushing water flows from the tank 36 through the conduit 40 and subsequently through the first annular ring 24 into the toilet bowl 34. As will be appreciated more fully hereinafter, the water exits the toilet bowl 34 in the usual manner with conventional toilets.

Figure 5:
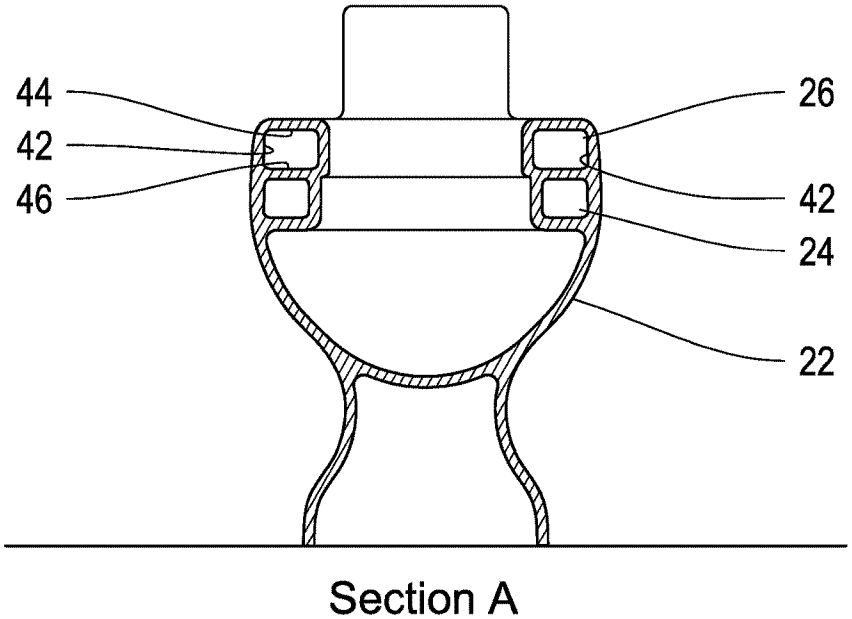
FIG. 5 illustrates a front sectional view of the ventilated toilet assembly in accordance with the disclosure herein taken along line A-A of FIG. 2.
Figure 6:
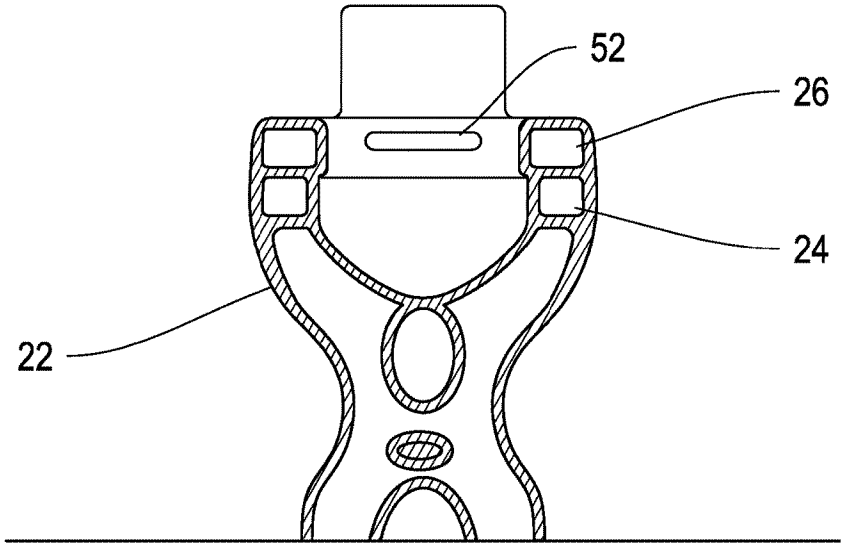
FIG. 6 illustrates a front sectional view of the ventilated toilet assembly in accordance with the disclosure herein taken along line B-B of FIG. 2
Figure 7:
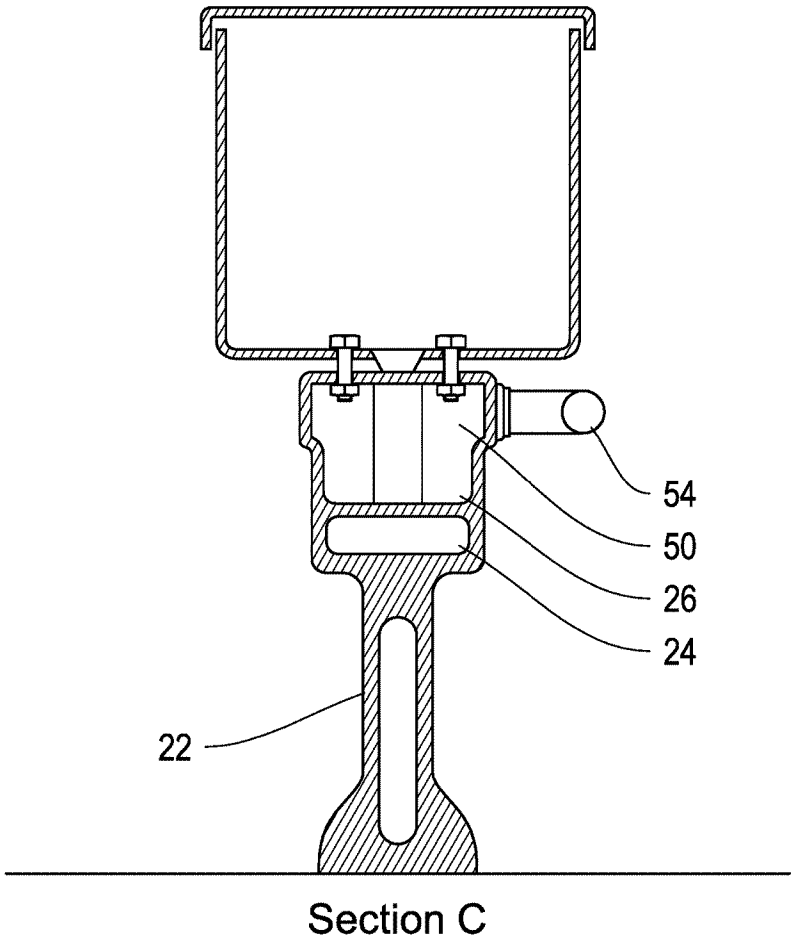
FIG. 7 illustrates a front sectional view of the ventilated toilet assembly in accordance with the disclosure herein taken along line C-C of FIG. 2.

With respect to FIGS. 2 & 5-7, and particularly to FIG. 5, there is shown the second annular ring 26 in detail in an exemplary embodiment. As illustrated, the second annular ring 26 sits on and surrounds the first annular ring 24, FIGS. 2, 5 & 6. It will be appreciated that in other exemplary embodiments, the two distinct rings are provided, a first and a second annular ring. In that embodiment, the second annular ring merely sits upon the first.

The second annular ring 26 has side walls 42, a top wall 44 and a bottom wall 46. Taken together, the walls 44, 46 and 48 define a conduit 50 for exhausting air through the second annular ring 26.

Figure 3:
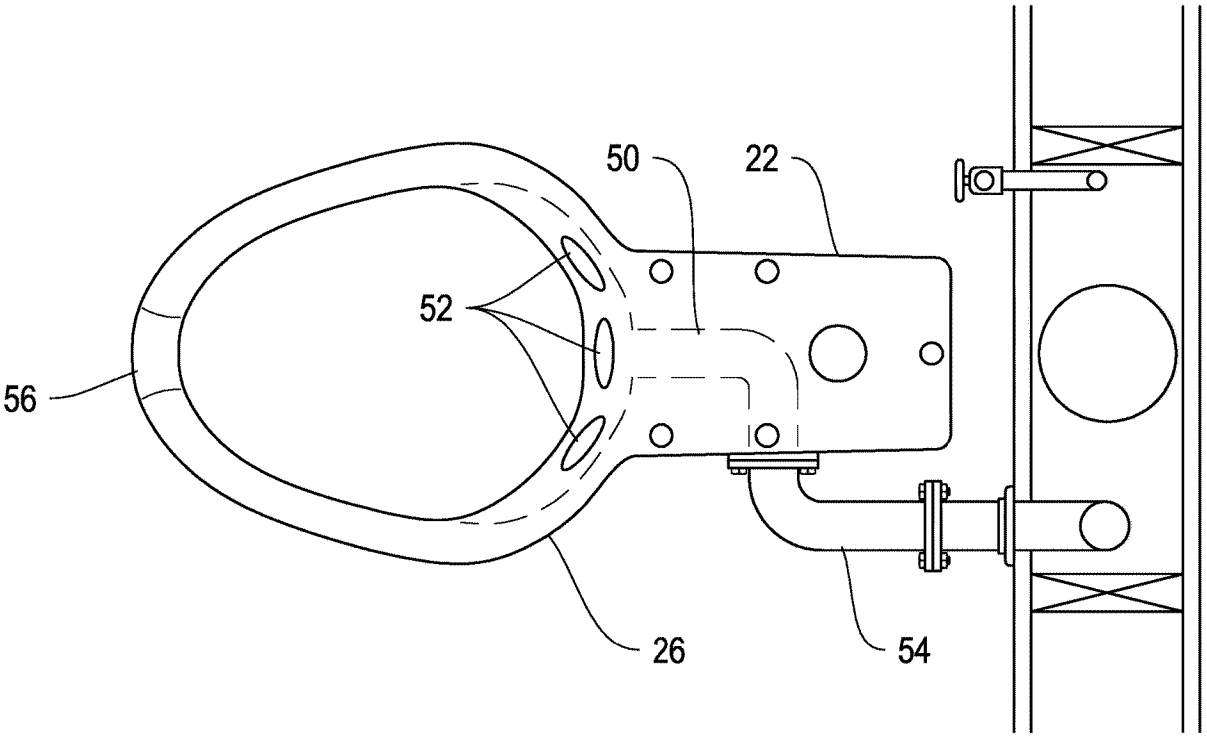
FIG. 3 illustrates a top view of the ventilated toilet assembly in accordance with the disclosure herein.
Figure 3A:
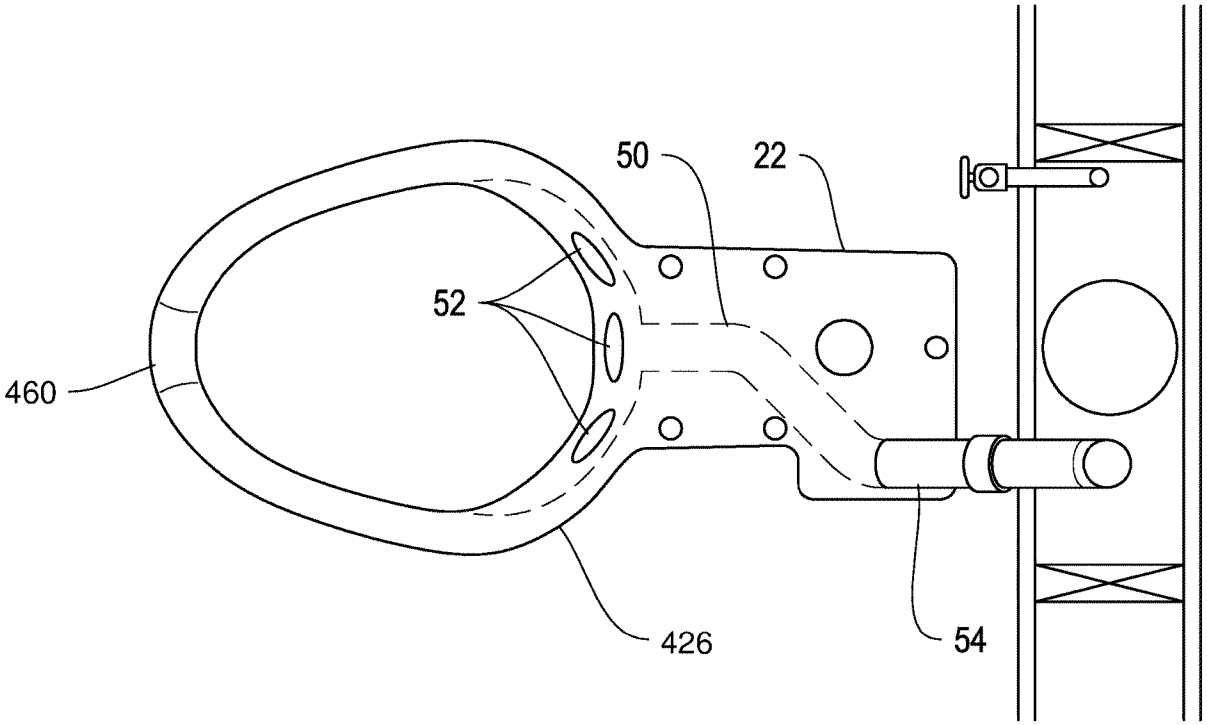
FIG. 3A illustrates a top view of an alternative embodiment of the ventilated toilet assembly in accordance with the disclosure herein.

As shown in FIG. 3, the second annular ring 26 has an exhaust port. In the exemplary embodiment illustrated, the exhaust port comprises three openings 52. Each of the openings 52 is in communication with the conduit 50. Also as shown in FIG. 3, the base 22 is connected to an exhaust member 54. Each of the exhaust ports 52 are in communication with the exhaust member 54. An exhaust fan, not shown, draws the air from the toilet bowl 34, out the exhaust ports 52, through the conduit 50 and to the desired location through the exhaust member 54. At the desired location, the exhausted waste air can be treated or sanitized as desired before being released in the ambient air. In an exemplary embodiment, the air is treated and recirculated back into the toilet bowl 34. This defines a recirculating system. This may be particularly useful where the toilet assembly is traveling in a closed space for example an airline or space capsule or a bus or motorhome or like applications where applicable laws allow.

Taken together, the second annular ring 26, the conduit 50, the exhaust port 52 define a ventilation member. It will be appreciated that the ventilation member for exhausting air from the toilet bowl is usable in recirculating or open ventilation systems. In addition, the ventilation member can be applied to a variety of different toilet with very little change to the structure of the basic conventional toilet.

As shown in considerable detail in FIGS. 2 and 5-7, the second annular ring 26 walls 42 and 46 are purposely designed in an exemplary embodiment to slope downward toward the exhaust ports 52. This is designed to be the lowest point in the conduit 50. The lowest point defines a drain and is in communication with the first annular ring. Thus, in the event that the toilet bowl 34 overflows, the overflow water drains to the lowest point in the conduit 50 and is thereby removed from the conduit 50 through the exhaust member 54.

Additionally, the bottom of the exhaust pipe connection is positioned above the bottom of the weir for preventing any backflow into the exhaust pipe in the event of toilet overflow. Additionally, when installed the exhaust pipe continues upward in the wall a minimum of several inches to reduce the impact of potential backup of liquid into the exhaust pipe.

Figure 4:
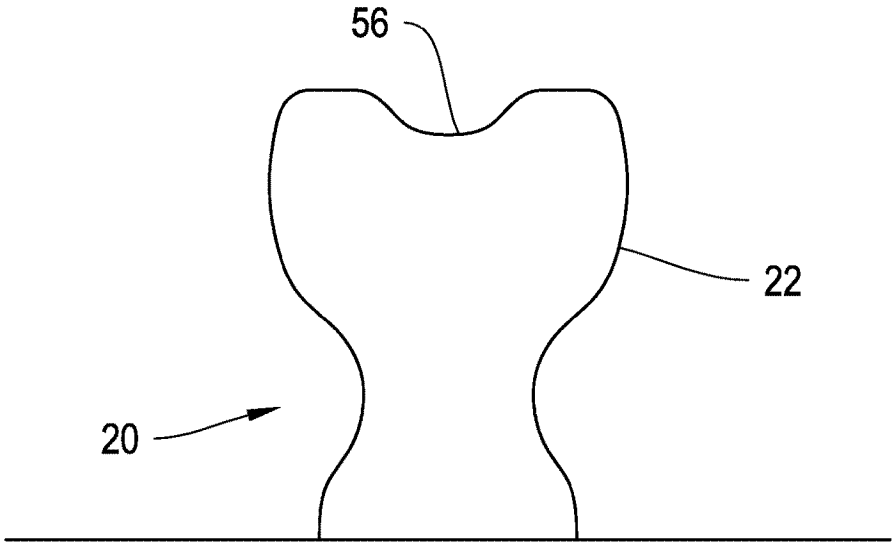
FIG. 4 illustrates a front elevational view of the ventilated toilet assembly in accordance with the disclosure herein.

Also as shown in detail in FIGS. 2 and 4, the second annular ring 26 is mostly hollow. However, as seen best in FIG. 4, the front portion of the second annular ring 26 has a depressed portion, centrally located at the front of the ventilated toilet assembly 20. The depressed portion is solid and defines a weir 56. It will be appreciated that in other embodiments, the depressed portion may be open and not solid and that, too, would be within the spirit and scope of the disclosure herein.

As shown, the weir 56 is depressed down to the top of the first annular ring 24. Thus, at the center portion of the weir, the weir 56 is exceedingly thin in one exemplary embodiment. It is not specifically necessary for the exaggerated thinness shown in the drawing for the weir to function in accordance with the disclosure herein. Specifically, should the toilet bowl 34 overflow, the depressed weir 56 provides an outlet for the water to spill rather than overflow into the conduit 50. Thus, using the weir structure herein, the second annular ring 26 is kept as dry as possible, since the height of the weir at its highest point is only slightly above the highest surface of the first annular ring 24. Naturally, the thicker the weir 56 is at its lowest point, the greater the likelihood that water will enter the conduit 50. Thus, while a thin weir 56 is preferred at the depression, there are, of course, practical limitations. Nevertheless, the weir for this purpose, may in another exemplary embodiment, be split into two parts, leaving a space between to allow overflow water an outlet before reaching the second annular ring.

The weir 56 functions to provide a minimum open area from the toilet bowl 34 interior to the surrounding space. Using the structure described herein, a minimum front to back airflow in the bowl is maintained when a person is seated on the toilet seat 28. Additionally, excessive suction is prevented which could potentially injure a person seated on the toilet seat 28. For example if there were a malfunction of the exhaust system or even during regular use suction is caused inside the bowl when the toilet is flushed. As a result of the weir 56 suction levels cannot rise to the point of being harmful.

As can be seen from FIGS. 1, 3 And 9, the weir 56 is at the front of the ventilated toilet assembly 20, while the exhaust ports 52 are located at the back of the assembly 20. Thus, the exhaust ports 52 and the weir 56 are diametrically opposite one another.

The first annular ring 24 is in the general shape of a circle. Therefore, the first annular ring has a general diameter. Similarly, the second annular ring 26 is in the general shape of a circle. Therefore, the second annular ring has a general diameter. The second annular ring 26 has a general diameter less than the first annular ring 24. Thus, even with wear over time the second annular ring 26 will not slip into the bowl 34.

The second annular ring 26 overhangs the first annular ring 24 at the back of the bowl 34. Thus, the exhaust ports 52 are positioned for ready communication with the exhaust member 54. It will be appreciated that while three exhaust ports are shown in the illustrated embodiment, another exemplary embodiment has a single exhaust port; while still another exemplary embodiment has a dual exhaust port. Additionally, it has been found that approximately 5 square inches of exhaust port area is sufficient to fully cycle the toilet assembly and provide fresh air to the bowl 34. Other exemplary embodiments that have more or less than 5 square inches of exhaust port area are also within the spirit and scope of this disclosure.

The weir is sized so that it is 1) larger than the overflow pipe inside the tank such that the weir can overflow at least the same water flow rate as the overflow pipe in the tank (which overflows into the bowl); 2) large enough to prevent enough suction to cause harm to a person when the toilet is flushed; 3) about a third of the "free area" when a person sits on the toilet, ⅔ being between the person's legs, ⅓ at the weir.

If a large person fully blocks the seat opening, this ⅓ area functions to provide about ⅓ of the design airflow (and capture velocities are maintained which is more a function of negative static pressure inside the bowl) which is desirable to maintain a minimum fan airflow rate and maintain front to back airflow inside the bowl. Front to back airflow is more effective than mixing in terms of what is described as "ventilation efficiency" (ASHRAE-62).

Figure 8:
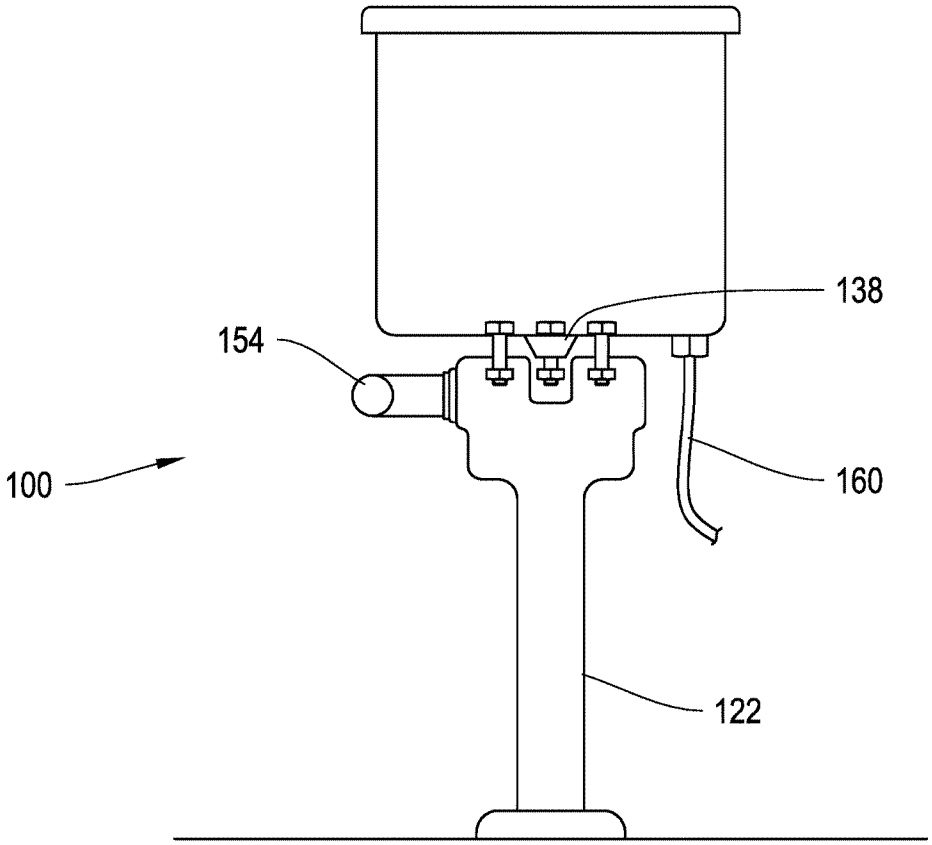
FIG. 8 is a rear elevational view of the ventilated toilet assembly in accordance with the disclosure herein.

With particular reference to FIG. 8, there is illustrated the rear view of the ventilated toilet assembly 100, As can be seen in FIG. 8, the exhaust member 154 directs air from the toilet bowl (not shown) to the desired location. The water tank is secured to the base 122 and sealed from leaking by a gasket 138. Water is provided into the tank through inlet 160. FIG. 8 illustrates a regular flow flush tank.

In another exemplary embodiment, a commercial type flush arrangement is used. For example, within the spirit and scope of the disclosure herein, a ventilated toilet assembly having a high pressure flush valve is contemplated. The operation structure of the known commercial toilet is maintained in this embodiment, while the ventilation member described herein is adapted to the existing toilet bowl and corresponding structure in the same manner as described above.

Figure 9B:
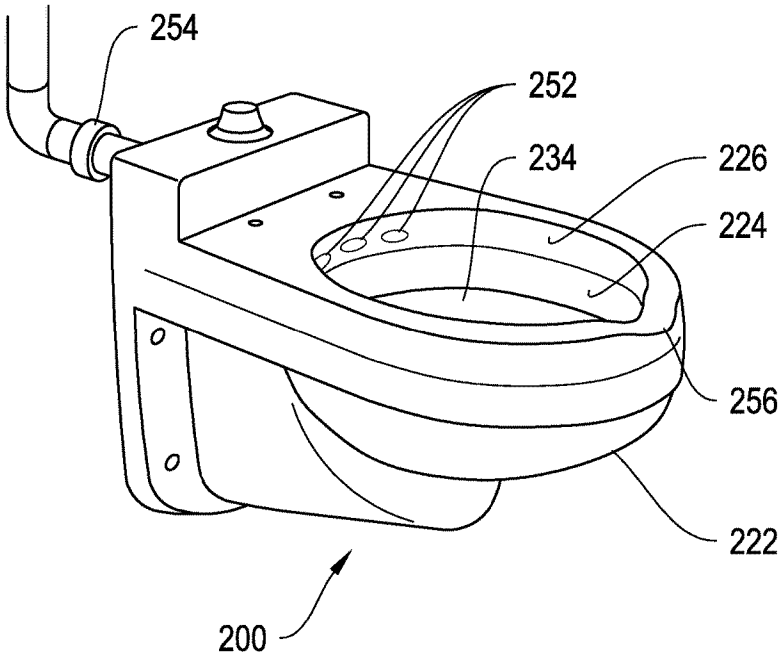
FIGS. 9A and 9B illustrate in side by side perspective views of a prior art toilet and the ventilated toilet assembly in accordance with the disclosure herein.
Figure 9A:
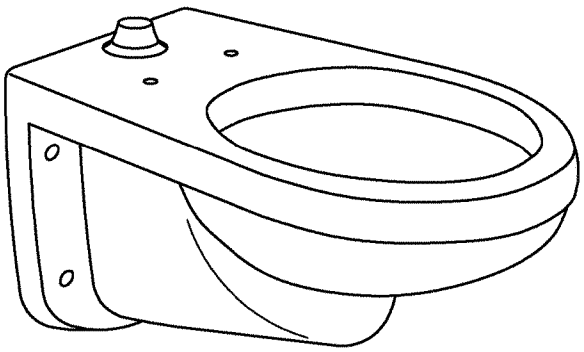
Prior Art FIG. 9A

With particular reference to FIG. 9, there is shown FIGS. 9A and 9B. FIG. 9A is the prior art toilet bowl used for wall mounting as is well known. FIG. 9B illustrates a similar wall mounted bowl adapted to include the disclosed ventilated toilet assembly.

With particular reference to FIG. 9B, there is shown a wall mounted ventilated toilet assembly 200 in accordance with this disclosure and generally indicated by the numeral 200. The wall mounted ventilated toilet assembly 200 includes a base 222, a first annular ring 224, a second annular ring 226. Not shown but similar to the exemplary embodiment described with respect to FIGS. 1 and 2 above, an exemplary embodiment includes a toilet seat and a gasket between the toilet seat and the second annular ring. Additionally, this embodiment includes a toilet seat cover (not shown) which covers the toilet seat.

In the exemplary embodiment illustrated in FIG. 9B, the ventilated toilet assembly 200, the base 222 comprises a standard wall mounted toilet base. The base 222 is mounted on the wall of a bathroom in a typical commercial application. The base 222 is typically made from porcelain as is well known. However, in the future other materials may become available and more well-suited for the purposes herein. The invention is specifically not limited to any particular base 222 material.

The base 222 has a central opening 234 defining a toilet bowl. The central opening is left open until covered.

The first annular ring 224 sits on the base 222 as illustrated. As is conventional, the first annular ring 224 carries water from outside the toilet bowl 234 to the surface of the toilet bowl 234 in a manner commonly known. In a commercial embodiment, the flush system uses a high pressure flush valve as described above. In another commercial embodiment, the flush system uses a tank.

As illustrated, the second annular ring 226 sits on the first annular ring 224. It will be appreciated that in other exemplary embodiments, the two distinct rings are provided, a first and a second annular ring. In that embodiment, the second annular ring merely sits upon the first.

In another exemplary embodiment, the first and second annular rings and the base are integrated and appear physically as a single unit.

The second annular ring 226 in all respects functions in the same manner as the, the second annular ring 26 and for that reason, the detail of this embodiment is not shown, but it is clearly understood by those skilled in the art. The second annular ring 226 includes an exhaust port. In the exemplary embodiment illustrated, the exhaust port comprises three openings 252. Each of the openings 252 is in communication with the conduit. Also as shown, the base 222 is connected to an exhaust member 254. Each of the exhaust ports 252 are in communication with the exhaust member 254. An exhaust fan, not shown, draws air from the toilet bowl 234 through the conduit, out the exhaust ports 252 and into the desired location through the exhaust member 254. At the desired location, the exhausted waste air can be treated or sanitized as desired before being released in the ambient air.

In an exemplary embodiment, the air is treated and recirculated back into the bowl. This defines a recirculating system. This may be particularly useful where the toilet assembly is traveling in a closed space for example an airline or space capsule or a bus or motorhome.

Taken together, the second annular ring 226, the conduit, the exhaust port 252 define a ventilation member. It will be appreciated that the ventilation member for exhausting air from the toilet bowl is usable in recirculating or open ventilation systems. In addition, the ventilation member can be applied to a variety of different toilet with very little change to the structure of the basic conventional toilet.

The second annular ring 226 is mostly hollow. However, as shown clearly in best in FIG. 9B, the front portion of the second annular ring 226 has a depressed portion, centrally located at the front of the ventilated toilet assembly 220. The depressed portion is solid and defines a weir 256. It will be appreciated that in other embodiments, the depressed portion may be open and not solid and that, too, would be within the spirit and scope of the disclosure herein.

As shown, the weir 256 is depressed down to the top of the first annular ring 224. Thus, at the center portion of the weir, the weir 256 is exceedingly thin in one exemplary embodiment. It is not specifically necessary for the exaggerated thinness shown in the drawing for the weir to function in accordance with the disclosure herein. Specifically, should the toilet bowl 234 overflow, the depressed weir 256 provides an outlet for the water to spill rather than overflow into the conduit. Thus, using the weir structure herein, the second annular ring 26 is kept as dry as possible, since the height of the weir at its highest point is only slightly above the highest surface of the first annular ring 224. Naturally, the thicker the weir 256 is at its lowest point, the greater the likelihood that water will enter the conduit.

Thus, while a thin weir 256 is preferred at the depression, there are, of course, practical limitations. Thus to overcome such physical limitations, the second annular ring 226 for this purpose, in another exemplary embodiment, is split into two parts, leaving a space between to allow overflow water an outlet before reaching the second annular ring 226 and defining a horse shoe shape. Thus, in this exemplary embodiment, the weir does not exist and there is no unity regarding the second annular ring 226, which would more correctly define a horse shoe.

The first annular ring 224 is in the general shape of a circle. Therefore, the first annular ring has a general diameter. Similarly, the second annular ring 226 is in the general shape of a circle. Therefore, the second annular ring has a general diameter. The second annular ring 226 has a general diameter less than the first annular ring 224. Thus, even with wear over time the second annular ring 226 will not slip into the bowl 234.

The second annular ring 226 overhangs the first annular ring 224 at the back of the bowl 234. Thus, the exhaust ports 252 are positioned for ready communication with the exhaust member 254. It will be appreciated that while three exhaust ports are shown in the illustrated embodiment, another exemplary embodiment has a single exhaust port; while still another exemplary embodiment has a dual exhaust port. Additionally, it has been found that approximately 5 square inches of exhaust port area is sufficient to fully cycle the ventilated toilet assembly 220 and provide fresh air to the bowl 234. The previous discussion above regarding sizing of the weir is also applicable here. Other exemplary embodiments that have more or less than 5 square inches of exhaust port area are also within the spirit and scope of this disclosure.

Figure 10B:
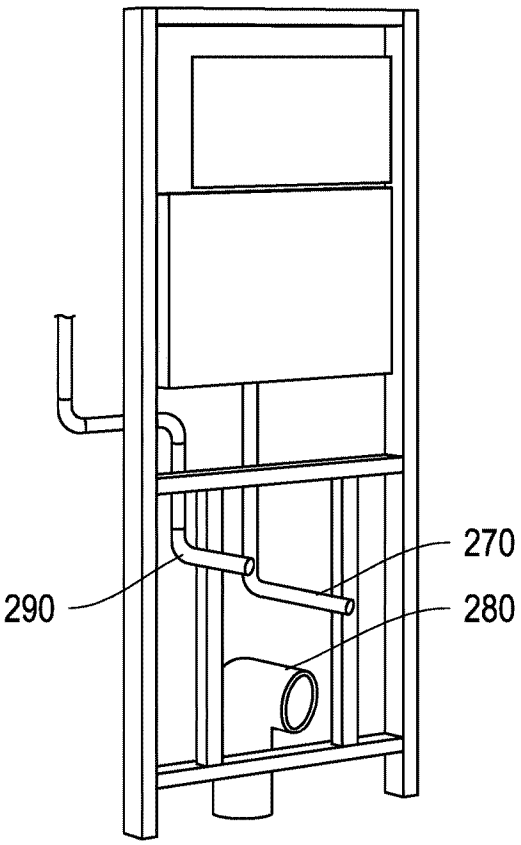
FIGS. 10A and 10B illustrate in side by side perspective views of the plumbing for the prior art toilet and the ventilated toilet assembly of FIGS. 9A and 9B, respectively.
Figure 10A:
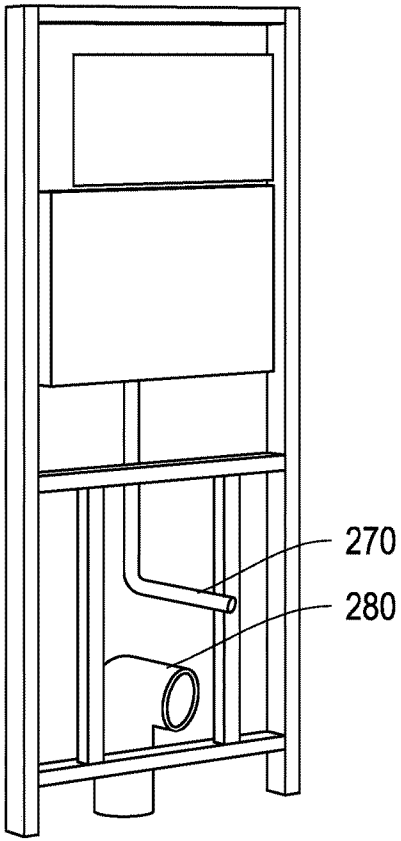
Prior Art FIG. 10A

With respect to FIG. 10, there is shown the plumbing for the wall mounted units. FIG. 10A illustrates the plumbing for the prior art wall mounted unit and FIG. 10B illustrates the plumbing for the ventilated toilet assembly 220. In each FIGS. 10A and 10B, there is illustrated the conventional lines coming into and out of the commode. The inlet water line 270 comes from the water source through the wall and into the toilet assembly in both the prior art device and the ventilated toilet assembly 220. Additionally, the sewage line 280 for receiving waste from the toilet is shown connected to each device.

FIG. 10B illustrates the addition of an air exhaust line 290. The exhaust member 254 connects to the air exhaust line 290 and with the aid of an exhaust fan (not shown) removes the waste air from the bowl 234 as described above. The waste air is drawn from the bowl through the exhausts 252 out the exhaust member 254 and to the desired location through the exhaust line 290 where it can be treated and return to the ambient air.

Figure 1A:
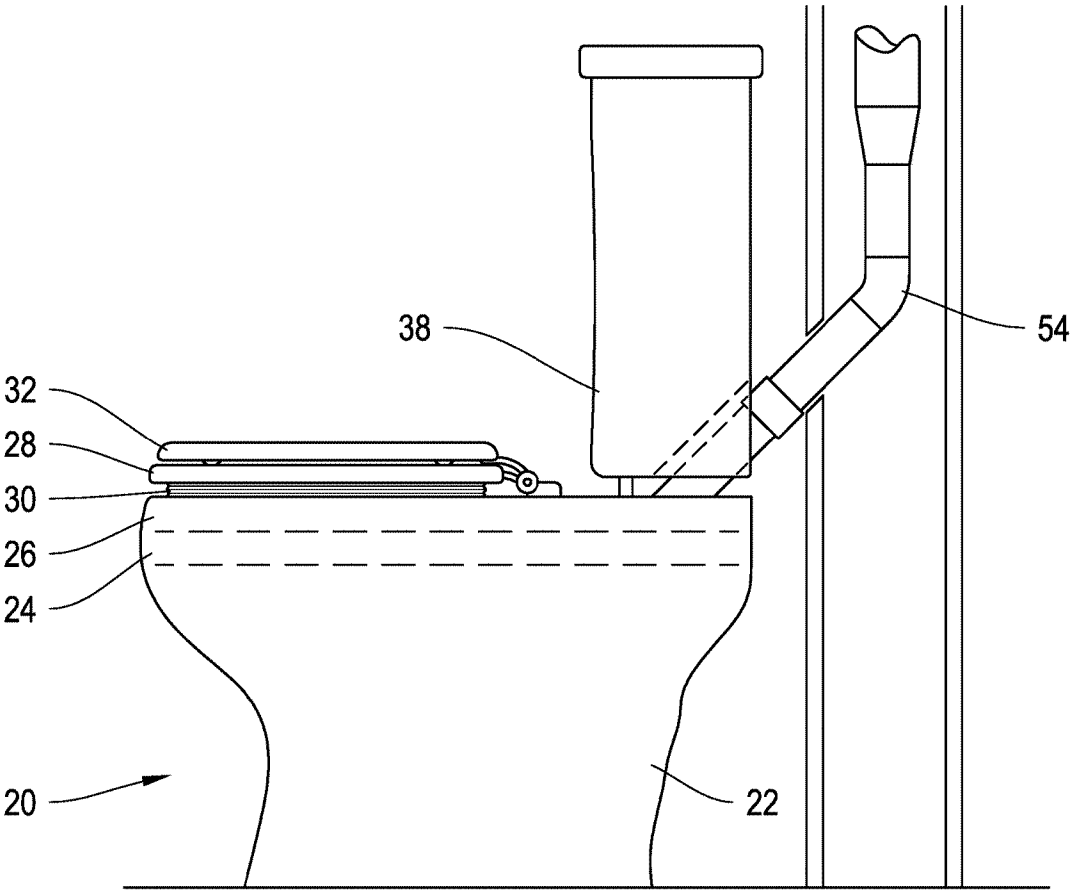
FIG. 1A illustrates a side perspective view of an alternative embodiment of the ventilated toilet assembly in accordance with the disclosure herein.

With particular respect to FIGS. 1A, 3A, 8A and 11, an alternative embodiment of the ventilated toilet assembly is described below and generally indicated by the numeral 400. As shown in FIG. 1A, the ventilated toilet assembly 400 disclosed herein includes a base 22, a first annular ring 24, a second annular ring 426, a toilet seat 28 and a gasket 30 between the toilet seat 28 and the second annular ring 426. Additionally, a toilet seat cover 32 is provided which covers the toilet seat 28.

In this exemplary embodiment, the back of the toilet assembly 400 includes a water tank 438 attached to the base 22. The tank 438 is attached to the upper portion of the base 22 and the connection there between is sealed using a gasket 38 as described above. As is conventional, water flows from the tank 438 through a conduit 430 to the first annular ring 24. Upon flushing water flows from the tank 438 through the conduit 40 and subsequently through the first annular ring 24 into the toilet bowl 436. As described above, the water exits the toilet bowl 436 in the usual manner with conventional toilets.

Figure 11:
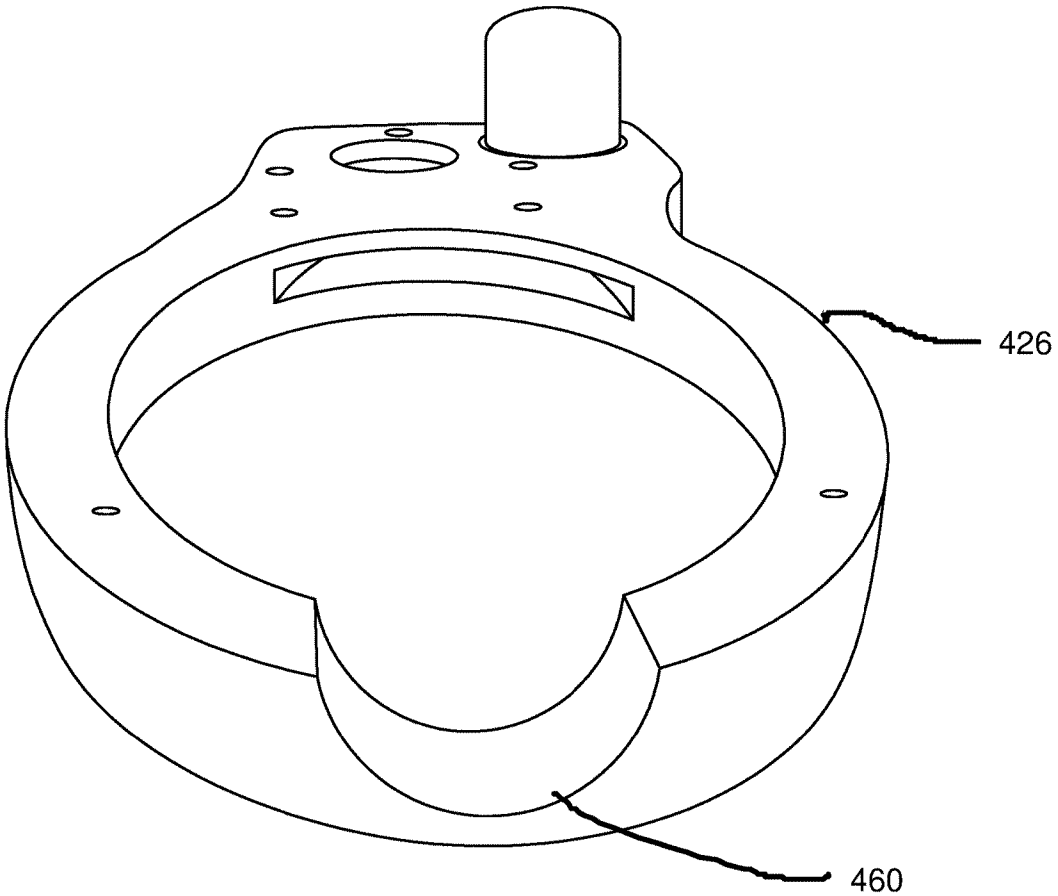
FIG. 11 illustrates a front perspective view of the second annular ring of the ventilated toilet assembly in accordance with the disclosure herein.

As illustrated, the second annular ring 426 sits on and surrounds the first annular ring 24. As shown in FIG. 11, the second annular ring 426 has an exhaust port 428. In this exemplary embodiment, the exhaust port 428 comprises a single opening. The opening 428 is in communication with a conduit 430, which defines an exhaust member. Also as shown in the embodiment illustrated in FIGS. 1A and 3A, the exhaust member defines a pipe and is at approximately a 45° angle to the horizontal.

In an exemplary embodiment, an exhaust fan member 440, shown in FIG. 1A, draws air from the toilet bowl 436 through the exhaust port 428, through the conduit 430 and through the exhaust member as illustrated. The exhausted waste air is then treated or sanitized as desired before being released in the ambient air.

In an exemplary embodiment, the exhaust fan member 440 includes the ability to treat and then inject the waste air back into the toilet bowl through its attachment to the second annular ring 426 as illustrated. The exhaust fan member 440 recirculates the waste air back into the toilet bowl 436, thus defining a recirculating waste air system.

In addition to treating the air to recirculation, the exemplary embodiment provides a filter 450 affixed within the exhaust member having a sliding door 452 for easy access to the filter 450. This exemplary embodiment is particularly useful where the toilet assembly 400 resides in a limited space. For example, such applications would include an airline or space capsule or a bus or motorhome or the like. Of course, all applicable laws for such structures apply here.

With particular respect to FIG. 11, there is shown the alternative exemplary embodiment of the second annular ring 426. The second annular ring 426 is generally solid with the exception of the vent or exhaust port 428. Additionally, the second annular ring 426 has a depressed front portion, defining a weir 460, which is located approximately 180° from the exhaust port 428. In the event that the toilet bowl 436 overflows, the weir 460 is designed to be at a point lower than the lowest point of the exhaust port 428. Using this structure, the exemplary embodiment prevents water from being drawn into the ventilation system, but instead overflows from the bowl. This protects the electronic devices and insures continues proper maintenance of the ventilation system.

Figure 8A:
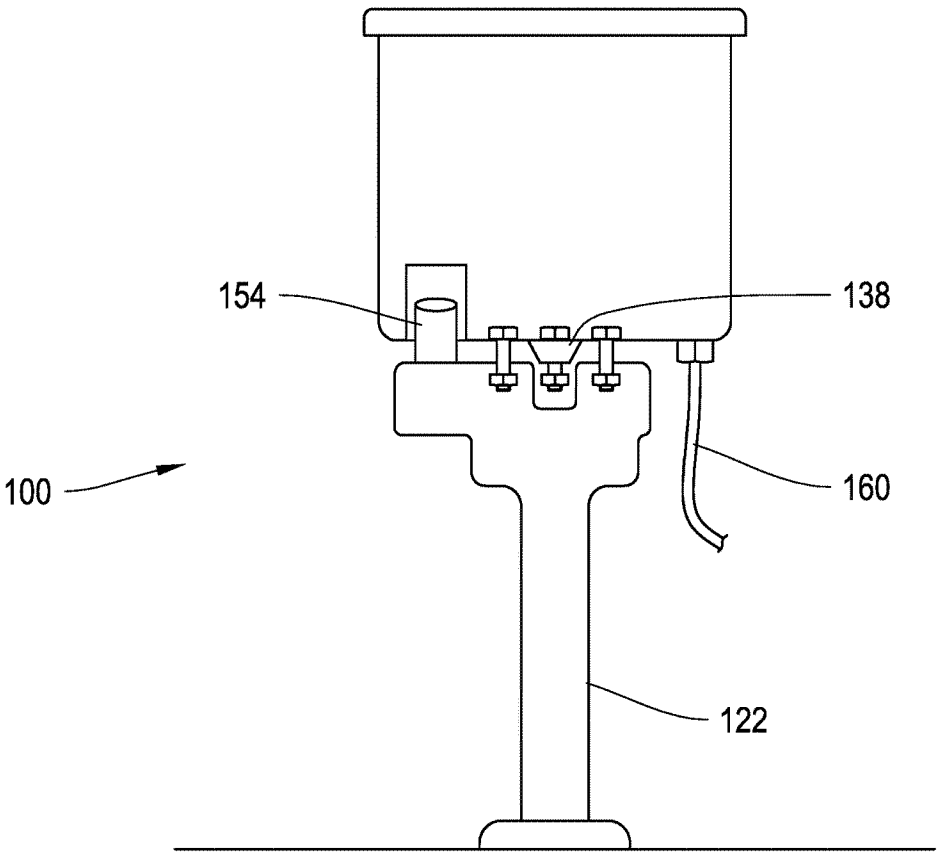
FIG. 8A illustrates a rear elevational view of an alternative embodiment of the ventilated toilet assembly in accordance with the disclosure herein.

The exhaust member 430 comes directly off the back of the base 22 unlike on the side in the earlier described embodiments. In order to accommodate the exhaust member 430, the tank has an indent as best shown in FIG. 8A.

While the foregoing detailed description has described several embodiments of the ventilated toilet assembly in accordance with this disclosure, it is to be understood that the above description is illustrative only and not limiting of the disclosed invention. It will be appreciated that the embodiments discussed above and the virtually infinite embodiments that are not mentioned are all within the scope and spirit of this invention. Thus, the invention is to be limited only by the claims as set forth below.

What is claimed is:

1. A ventilated toilet assembly, the toilet assembly including a base with a central opening, the opening defining a toilet bowl, the ventilated toilet assembly comprising:

a first annular ring above the base, the first annular ring comprising structure for delivering water to the toilet bowl;

a second annular ring above the first annular ring, the second annular ring comprising side walls, a top wall and a bottom wall, the walls defining a conduit for exhausting air through the second annular ring; and the second annular ring being generally solid with the exception that the conduit is hollow and in communication with both the toilet bowl and the exhaust port and wherein an exhaust member is connected to the exhaust port at approximately a 45 degree angle and including a ventilation member, the ventilation member including the conduit for exhausting air from the toilet bowl, the conduit having an exhaust port in communication with the toilet bowl and the area outside the toilet bowl for exhausting air from the toilet bowl through the conduit.

2. A ventilated toilet assembly as set forth in claim 1, wherein the ventilated toilet assembly has a front portion and a rear portion, the second annular ring having a depressed weir located near the front portion and the bottom portion of the weir is lower than the exhaust port, preventing toilet water from being drawn into the ventilation member.

3. A ventilated toilet assembly as set forth in claim 1, wherein the ventilated toilet assembly includes a water tank in communication with the first annular ring and wherein the water tank has an indent for accommodating the exhaust member.

4. A ventilated toilet assembly as set forth in claim 3, wherein the exhaust port is diametrically opposite the weir.

5. A ventilated toilet assembly as set forth in claim 4, wherein the lowest point of the weir is lower than the exhaust port for preventing liquid from entering the ventilation member.

6. A ventilated toilet assembly as set forth in claim 5, wherein the exhaust member is approximately 45 degrees to the horizontal and is located along the same plane as the weir and the exhaust port.

7. A ventilated toilet assembly as set forth in claim 6, wherein the tank has an indent to accommodate the exhaust member at its location approximately 45 degrees to the horizontal.

8. A ventilated toilet assembly as set forth in claim 1, wherein the exhaust port is diametrically opposite the weir.

9. A ventilated toilet assembly as set forth in claim 1, wherein there are a plurality of exhaust ports.

10. A ventilated toilet assembly as set forth in claim 1, wherein the first annular ring has a general diameter and where the second annular ring has a general diameter and the diameter of the second annular ring is smaller than the first annular ring, such that the second annular ring over hangs the first annular ring and wherein the exhaust port over hangs the bowl.

11. A ventilated toilet assembly as set forth in claim 10, wherein the first and second annular rings are integrated with the base.

12. A ventilated toilet assembly as set forth in claim 11, wherein the toilet assembly is provided with a toilet seat over the second annular ring and wherein a space is formed between the second annular ring and the toilet seat, and wherein a gasket member fills the space between the toilet seat and the second annular ring for preventing air from escaping the toilet bowl.

13. A ventilated toilet assembly as set forth in claim 12, wherein the second annular ring is generally hollow with the exception that a small portion is solid and that portion is depressed and defines a weir.

14. A ventilated toilet assembly as set forth in claim 1, wherein the toilet assembly includes a flush mechanism and wherein an air injection member connects to the second annular ring for injecting air into the conduit upon activation of the toilet assembly by the flush mechanism.

15. A ventilated toilet assembly as set forth in claim 1, wherein the toilet assembly includes a wall mounted base.

16. A ventilated toilet assembly as set forth in claim 1, wherein the toilet assembly includes a high pressure valve and no water tank is provided.

17. A ventilated toilet assembly as set forth in claim 1, wherein the odor created after toilet use is defined as waste air and wherein the waste air is captured by the second annular ring and moved into and through the exhaust port and then treated before being returned to the ambient air.

* * * * *